US010882710B2

(12) United States Patent
Taki

(10) Patent No.: US 10,882,710 B2
(45) Date of Patent: Jan. 5, 2021

(54) SHEET PROCESSING APPARATUS

(71) Applicant: TOSHIBA TEC KABUSHIKI KAISHA, Tokyo (JP)

(72) Inventor: Hiroyuki Taki, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 2 days.

(21) Appl. No.: 16/365,987

(22) Filed: Mar. 27, 2019

(65) Prior Publication Data

US 2020/0307939 A1 Oct. 1, 2020

(51) Int. Cl.
*B65H 29/38* (2006.01)
*B65H 31/24* (2006.01)

(52) U.S. Cl.
CPC ..... *B65H 29/38* (2013.01); *B65H 31/24* (2013.01)

(58) Field of Classification Search
CPC ..... B65H 5/02; B65H 9/101; B65H 29/38; B65H 29/44; B65H 31/3081
USPC ..... 271/220, 271
See application file for complete search history.

(56) References Cited

U.S. PATENT DOCUMENTS 5,419,545 A * 5/1995 Hutson ..... B65H 29/14 271/220
5,467,974 A * 11/1995 Ishiwata ..... B65H 31/26 271/177
6,199,853 B1 * 3/2001 Andoh ..... B42C 1/12 270/58.14
7,392,983 B2 * 7/2008 Kodama ..... B65H 37/04 270/58.01
7,530,565 B2 5/2009 Terao et al.
7,661,666 B2 2/2010 Terao et al.
8,480,078 B2 * 7/2013 Kubota ..... B65H 29/26 270/58.07
9,758,335 B2 9/2017 Taki
10,071,875 B2 9/2018 Taki
2010/0150636 A1 * 6/2010 Kubota ..... B42C 1/12 399/407

FOREIGN PATENT DOCUMENTS

JP 2007-076896 A 3/2007

* cited by examiner

*Primary Examiner* — Leslie A Nicholson, III
(74) *Attorney, Agent, or Firm* — Kim & Stewart LLP

(57) ABSTRACT

A sheet processing apparatus includes a processing tray, a pushing member, and a movable guide. One or more sheets to be processed are placeable on the processing tray for sheet processing. The pushing member is configured to push an edge of the one or more sheets on the processing tray on an upstream side in a sheet conveying direction, by moving along a surface of the processing tray in the sheet conveying direction. The movable guide is movable to a sheet pressing position at which a distance between the surface of the processing tray and the movable guide is equal to or less than a height of the pushing member above the surface of the processing tray. The movable guide is at the sheet processing position when the pushing member moves along the surface of the processing tray in the sheet conveying direction.

26 Claims, 13 Drawing Sheets

SHEET PROCESSING APPARATUS

FIELD

Embodiments described herein relate generally to a sheet processing apparatus.

BACKGROUND

There is a sheet processing apparatus that performs post-processing, such as sorting and stapling, on a sheet-like recording medium (hereinafter, collectively referred to as "sheet") conveyed from an image processing apparatus. The sheet processing apparatus includes a processing unit and a discharge unit. The processing unit performs post-processing on the received sheet. The processing unit discharges the post-processed sheet to the discharge unit.

For example, when the processing unit discharges a processed sheet to the discharge unit, the edge of the sheet on the upstream side in the conveying direction may be pushed by a pushing member to the downstream side in the conveying direction to convey the processed sheet. However, the processed sheet pushed by the pushing member may buckle while being pushed.

DETAILED DESCRIPTION

Figure 1:
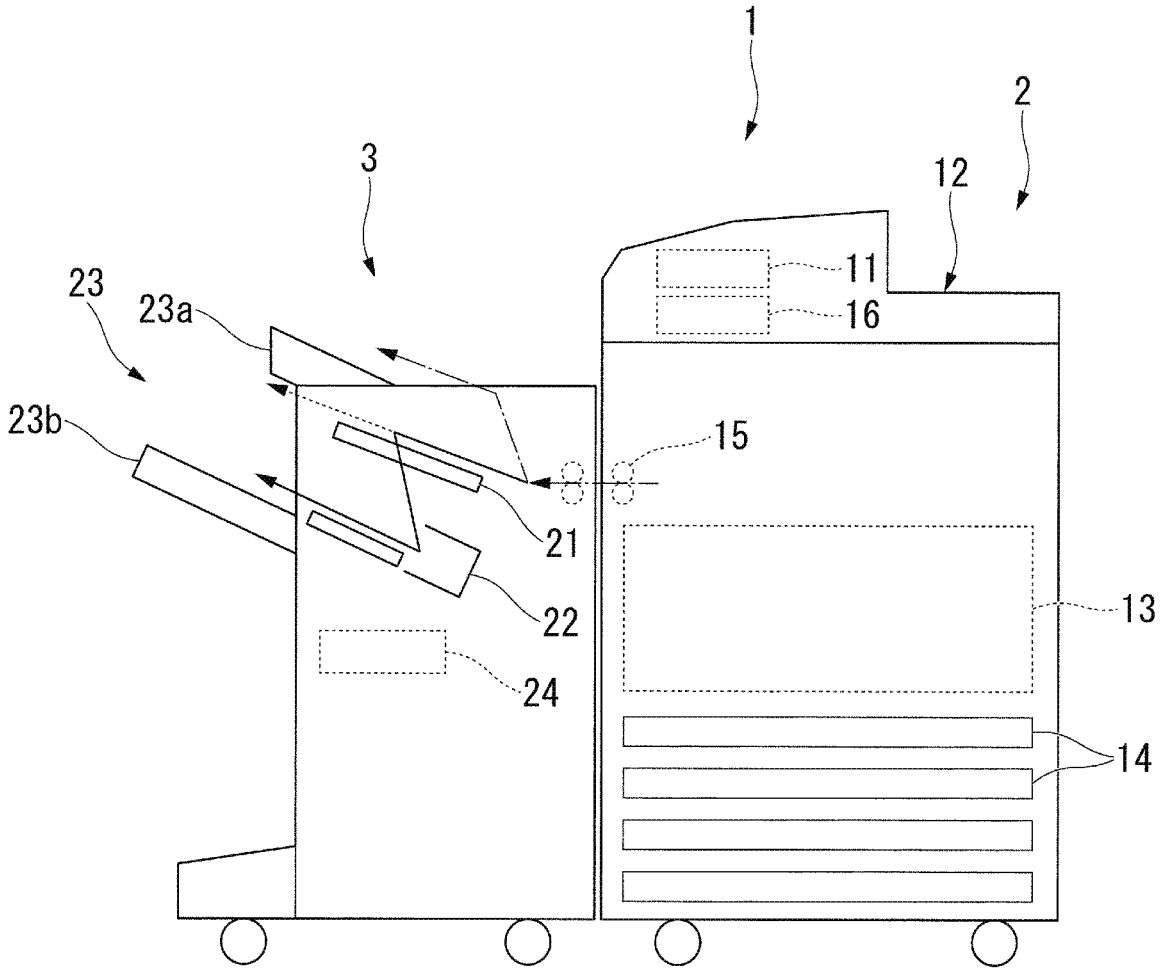
FIG. 1 illustrates an overview of an image forming system according to an embodiment.

In general, according to an embodiment, a sheet processing apparatus includes a processing tray, a pushing member, and a movable guide. One or more sheets to be processed are placeable on the processing tray for sheet processing. The pushing member is configured to push an edge of the one or more sheets on the processing tray on an upstream side in a sheet conveying direction, by moving along a surface of the processing tray in the sheet conveying direction. The movable guide is movable to a sheet pressing position at which a distance between the surface of the processing tray and the movable guide is equal to or less than a height of the pushing member above the surface of the processing tray. The movable guide is at the sheet processing position when the pushing member moves along the surface of the processing tray in the sheet conveying direction.

Hereinafter, a sheet processing apparatus according to the embodiment will be described with reference to the drawings. In the following description, the same reference numerals are assigned to components having the same or similar functions. Overlapping description of these configurations may be omitted.

Figure 2:
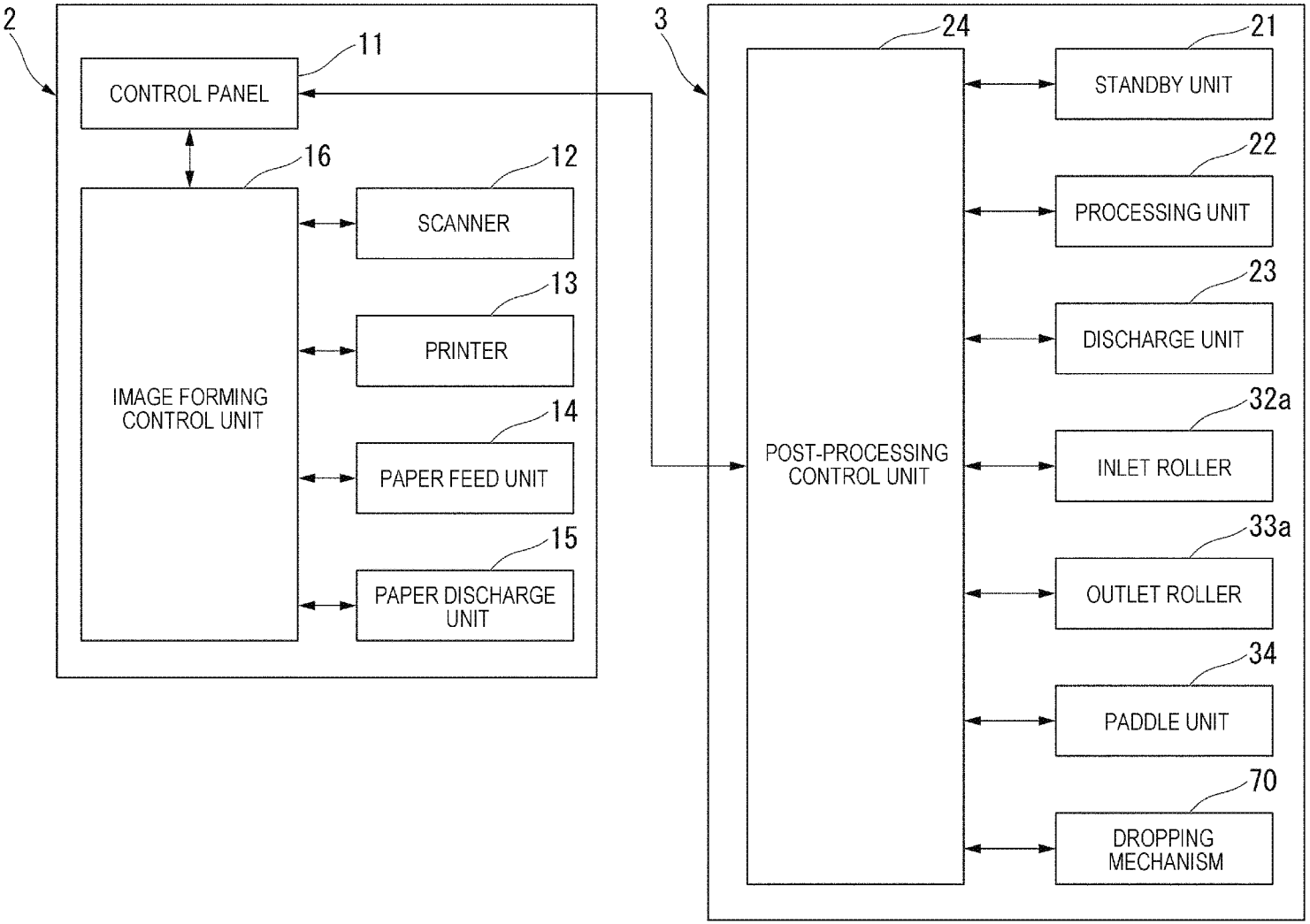
FIG. 2 is a block diagram illustrating a functional configuration of the image forming system according to the embodiment.

FIGS. 1 and 2 illustrate examples of the overall configuration of an image forming system 1.

As illustrated in FIGS. 1 and 2, the image forming system 1 includes an image forming apparatus 2 and a post-processing apparatus 3. The image forming apparatus 2 forms an image on a sheet-like recording medium such as paper (hereinafter, referred to as "sheet S"). The post-processing apparatus 3 performs post-processing on the sheet S conveyed from the image forming apparatus 2. The post-processing apparatus 3 is an example of a "sheet processing apparatus".

The image forming apparatus 2 includes a control panel 11, a scanner 12, a printer 13, a paper feed unit 14, a paper discharge unit 15, and an image forming control unit 16.

The control panel 11 includes various keys or touch panels that receive an operation of a user. For example, the control panel 11 receives an input selecting a type of post-processing to be performed on the sheet S. The image forming apparatus 2 transmits information on the type of post-processing input with the control panel 11 to the post-processing apparatus 3.

The scanner 12 includes a reading unit that obtains image information of an object to be duplicated. The scanner 12 transmits the image information to the printer 13.

The printer 13 forms an output image (hereinafter, referred to as "toner image") with a developer such as toner based on the image information transmitted from the scanner 12 or an external device. The printer 13 transfers the toner image onto a surface of a sheet S. The printer 13 applies heat and pressure to the toner image transferred onto the sheet S, to fix the toner image onto the sheet S.

The paper feed unit 14 supplies sheets S to the printer 13 one by one at a timing at which the printer 13 forms a toner image.

The paper discharge unit 15 conveys the sheets S which are discharged from the printer 13 to the post-processing apparatus 3.

The image forming control unit 16 controls an overall operation of the image forming apparatus 2. That is, the image forming control unit 16 controls the control panel 11, the scanner 12, the printer 13, the paper feed unit 14, and the paper discharge unit 15. The image forming control unit 16 is formed as a control circuit including a central processing unit (CPU), a read only memory (ROM), and a random access memory (RAM).

Next, the post-processing apparatus 3 will be described.

First, an overall configuration of the post-processing apparatus 3 will be described. As illustrated in FIG. 1, the post-processing apparatus 3 is disposed adjacent to the image forming apparatus 2. The post-processing apparatus 3 executes post-processing, which is instructed through the control panel 11, on sheets S conveyed from the image forming apparatus 2. For example, the post-processing includes a stapling process and a sorting process.

The post-processing apparatus 3 includes a standby unit 21, a processing unit 22, a discharge unit 23, and a post-processing control unit (control unit) 24.

The standby unit 21 temporarily retains (buffers) sheets S (refer to FIG. 3) conveyed from the image forming apparatus 2. For example, the standby unit 21 puts subsequent sheets S on standby during post-processing performed on preceding sheets S in the processing unit 22. The standby unit 21 is provided above the processing unit 22. For example, the standby unit 21 forms a bundle of sheets S by stacking plural sheets S. When the processing unit 22 is empty, the standby unit 21 drops the retained sheets S toward the processing unit 22.

The processing unit 22 performs post-processing on the conveyed sheets S. For example, the processing unit 22 aligns the plural sheets S. For example, the processing unit 22 performs a stapling process on the aligned sheets S. The processing unit 22 discharges the sheets S which are subjected to the post-processing to the discharge unit 23.

The discharge unit 23 includes a fixed tray 23*a* and a movable tray 23*b*. The fixed tray 23*a* is provided in an upper portion of the post-processing apparatus 3. The movable tray 23*b* is provided in a side portion of the post-processing apparatus 3. The sheets S that are subjected to the post-processing can be discharged to the fixed tray 23*a* and the movable tray 23*b*.

The post-processing control unit 24 controls an overall operation of the post-processing apparatus 3. That is, the post-processing control unit 24 controls the standby unit 21, the processing unit 22, and the discharge unit 23. Further, as illustrated in FIG. 2, the post-processing control unit 24 controls an inlet roller 32*a*, an outlet roller 33*a*, a paddle unit 34, and a dropping mechanism 111, which will be described below. The post-processing control unit 24 can be implemented with a control circuit including a CPU, a ROM, and a RAM similarly to the image forming control unit 16.

Next, configurations of each unit of the post-processing apparatus 3 will be described in detail.

Hereinafter, the configuration of the post-processing apparatus 3 will be described using a sheet conveying direction D1, a sheet conveying direction D2, and a sheet width direction W. The sheet conveying direction D1 is a direction indicated by a first arrow D1 illustrated in FIG. 3 and is a sheet conveying direction in the standby unit 21. That is, the sheet conveying direction D1 is an entry direction of the sheet S from a first outlet roller 33*a* and a second outlet roller 33*b* to a standby tray 41. Further, the sheet conveying direction D2 is a direction indicated by a second arrow D2 illustrated in FIG. 3 and is a sheet conveying direction in the processing unit 22. That is, the sheet conveying direction D2 is a discharge direction of the sheet S from a processing tray 61. The sheet width direction W is a direction substantially parallel to an upper surface (conveying surface) 45*b* of the standby tray 41, and is substantially orthogonal to the sheet conveying direction D1. In addition, a "trailing end" and a "trailing edge" used in the present application are intended to mean an "end on the upstream side" and an "edge on the upstream side" in the sheet conveying directions D1 and D2, respectively.

Figure 3:
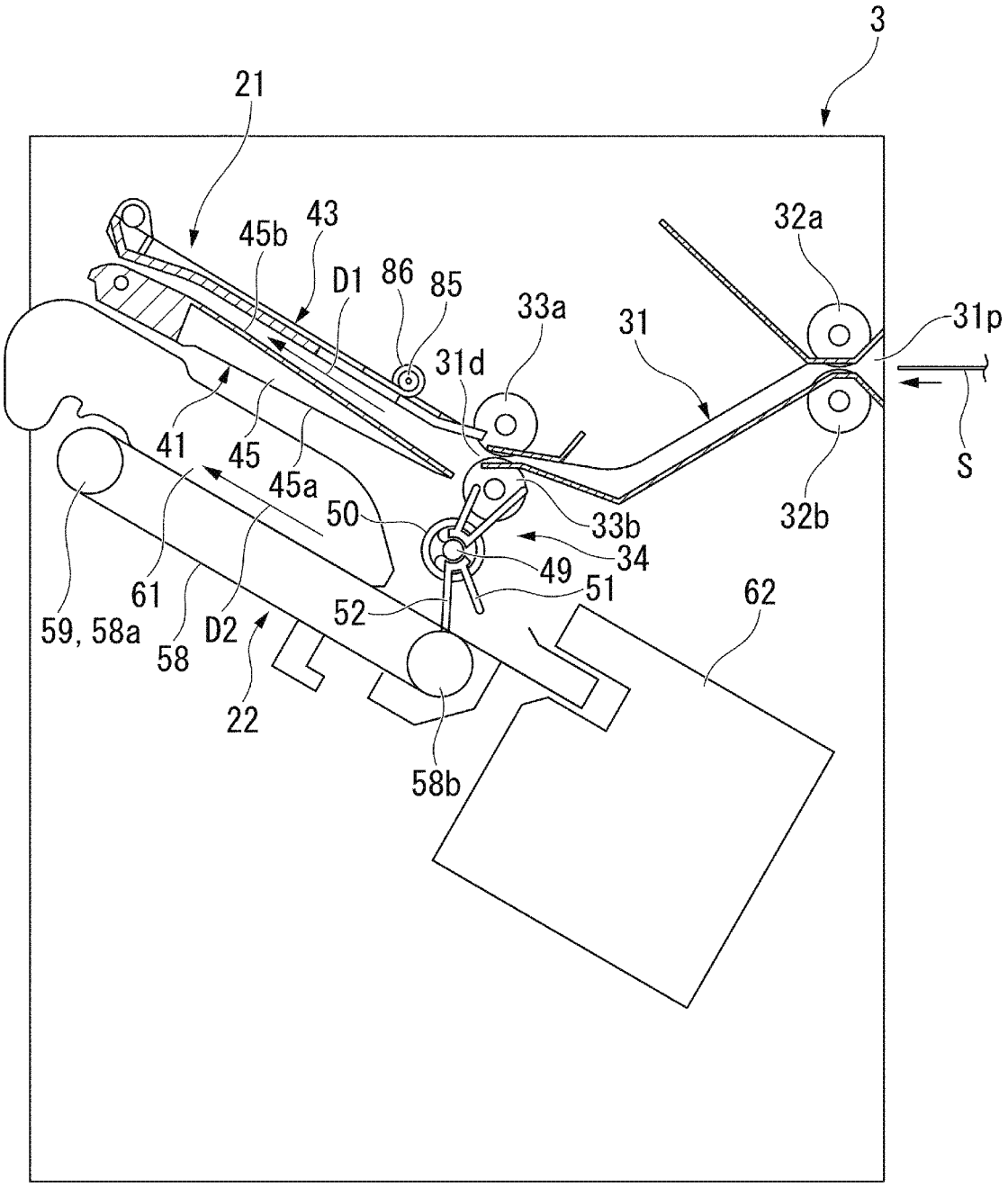
FIG. 3 illustrates a cross-sectional view of a post-processing apparatus according to the embodiment.

FIG. 3 illustrates a configuration of the post-processing apparatus 3.

As illustrated in FIG. 3, the post-processing apparatus 3 has a conveying path for the sheets S, a pair of inlet rollers 32*a* and 32*b*, a pair of outlet rollers 33*a* and 33*b*, the standby unit 21, the paddle unit 34, and the processing unit 22.

The conveying path 31 is provided inside the post-processing apparatus 3. The conveying path 31 has a sheet supply port 31*p* and a sheet discharge port 31*d*. The sheet supply port 31*p* faces the image forming apparatus 2. The sheets S are supplied from the image forming apparatus 2 to the sheet supply port 31*p*. The sheet discharge port 31*d* is located near the standby unit 21. The sheets S that pass through the conveying path 31 are discharged from the sheet discharge port 31*d* to the standby unit 21.

The inlet rollers 32*a* and 32*b* are provided near the sheet supply port 31*p*. The inlet rollers 32*a* and 32*b* convey the sheets S which are supplied to the sheet supply port 31*p* toward the downstream side of the conveying path 31. The inlet rollers 32*a* and 32*b* convey the sheets S to the outlet rollers 33*a* and 33*b*.

The outlet rollers 33*a* and 33*b* are provided near the sheet discharge port 31*d*. The outlet rollers 33*a* and 33*b* convey the sheets S conveyed by the inlet rollers 32*a* and 32*b* from the sheet discharge port 31*d* to the standby unit 21.

Next, the standby unit 21 will be described.

Figure 4:
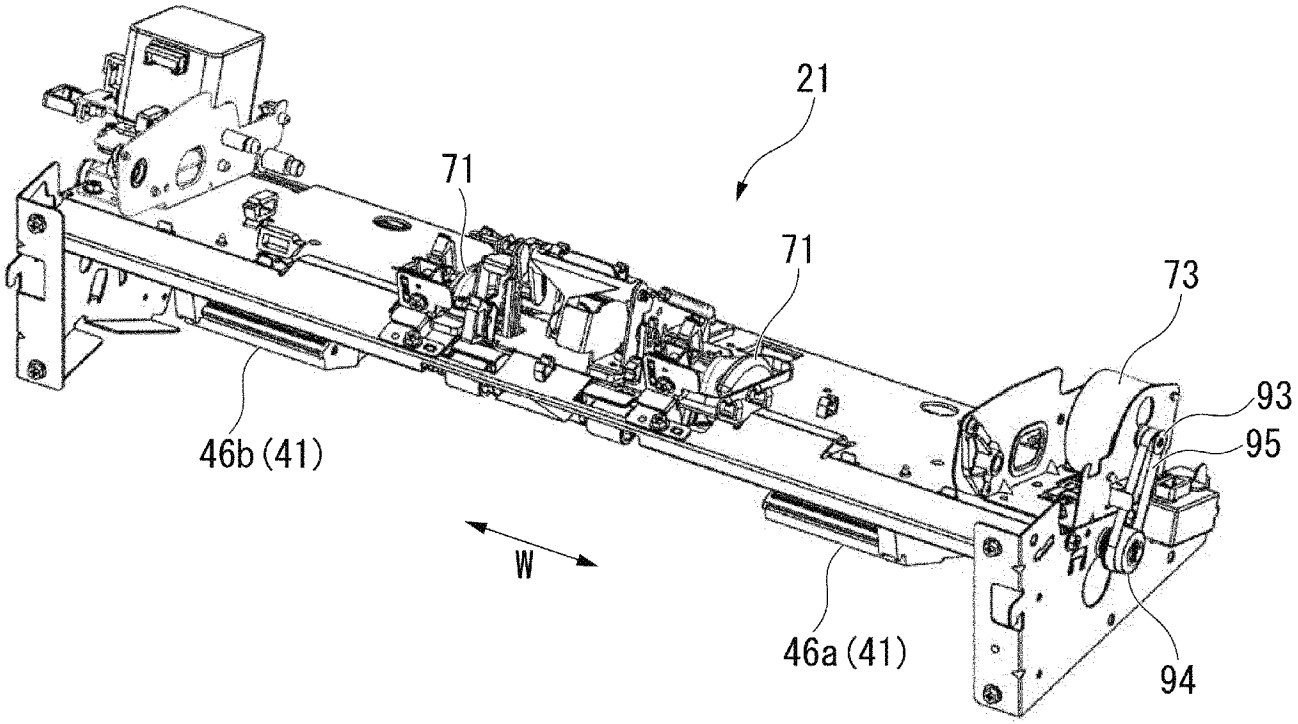
FIG. 4 illustrates a perspective view of a standby unit according to the embodiment.
Figure 5:
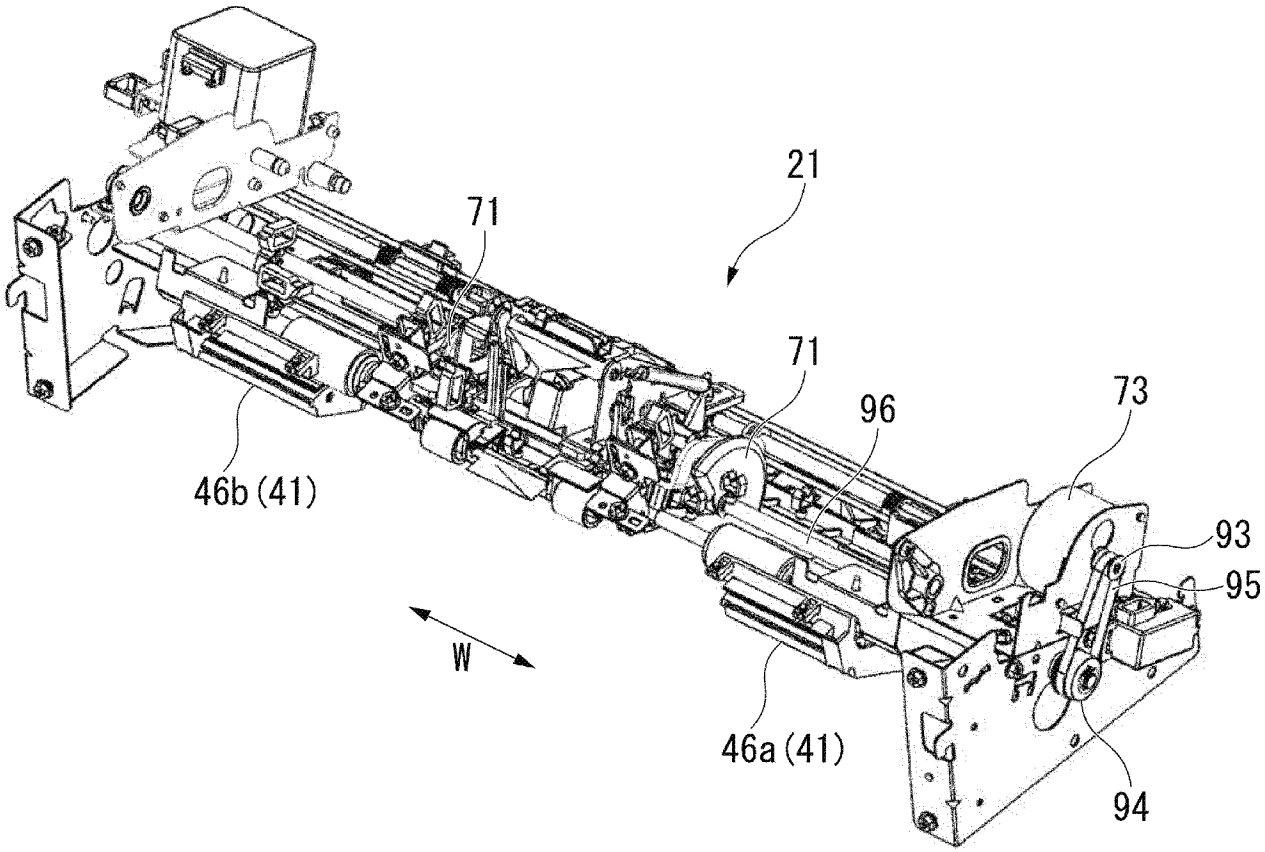
FIG. 5 illustrates a perspective view of an internal configuration of the standby unit according to the embodiment.

FIG. 4 illustrates the standby unit according to the embodiment. FIG. 5 illustrates an inner configuration of the standby unit according to the embodiment.

As illustrated in FIGS. 3 to 5, the standby unit 21 has the standby tray 41, an opening and closing drive unit 42 (refer to FIG. 6), and an assist guide 43. The assist guide 43 is an example of the "movable guide".

As illustrated in FIG. 3, the trailing end of the standby tray 41 is located near the outlet rollers 33*a* and 33*b*. The trailing end of the standby tray 41 is located lower than the sheet discharge port 31*d* of the conveying path 31. The standby tray 41 is tilted with respect to a horizontal direction so as to gradually increase in height toward the downstream side of the sheet conveying direction D1. During post-processing in the processing unit 22, the standby tray 41 puts the sheets S on standby.

The standby tray 41 has a bottom wall 45 and a side wall (not illustrated). The bottom wall 45 has a lower surface 45*a* and an upper surface 45*b*. The bottom wall 45 supports the sheets S from the lower side. The side wall supports the side portion of the sheets S in the sheet width direction W. The upper surface 45*b* supports the sheets S retained in the standby unit 21.

Figure 6:
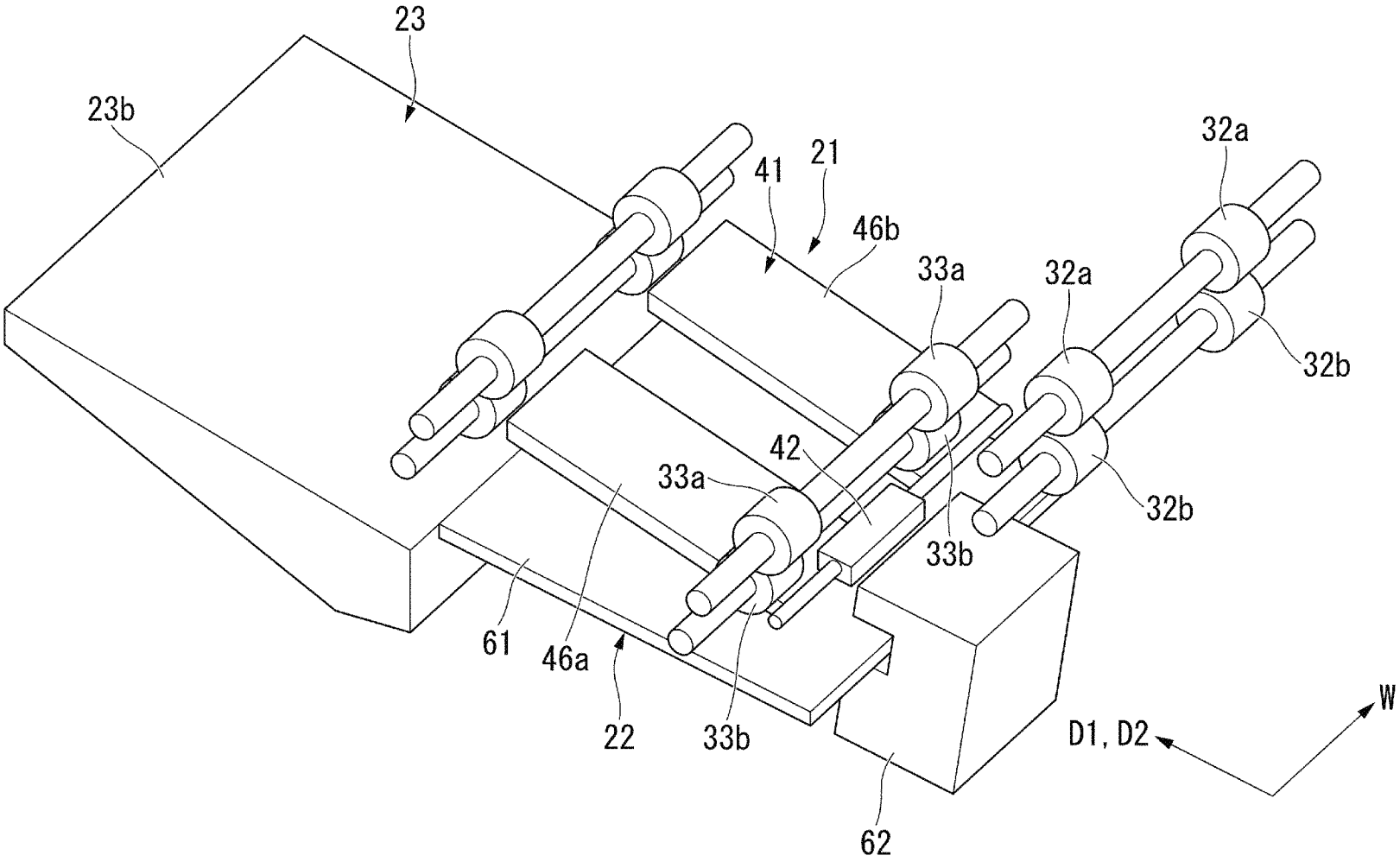
FIG. 6 illustrates a perspective view of the standby unit and a processing unit of the post-processing apparatus according to the embodiment.

FIG. 6 schematically illustrates the standby tray 41 and the processing unit 22.

As illustrated in FIG. 6, the standby tray 41 has a first tray member 46*a* and a second tray member 46*b* (refer to both FIGS. 4 and 5). The first tray member 46*a* and the second tray member 46*b* are separated from each other in the sheet width direction W. The first tray member 46*a* and the second tray member 46*b* are movable in a mutually approaching direction and a mutually separating direction.

The opening and closing drive unit 42 can drive the first tray member 46*a* and the second tray member 46*b* in the mutually approaching direction and the mutually separating direction. When the sheets S are held in the standby tray 41, the opening and closing drive unit 42 drives the first tray member 46*a* and the second tray member 46*b* to approach each other. As a result, the sheets S are supported by the first tray member 46*a* and the second tray member 46*b*. When the sheets S move from the standby tray 41 toward a processing tray 61 of the processing unit 22, the opening and closing drive unit 42 drives the first tray member 46*a* and the second tray member 46*b* to separate from each other. As a result, the sheets S supported by the standby tray 41 drop toward the processing tray 61 from a gap between the first tray member 46*a* and the second tray member 46*b*. Thus, the sheets S move from the standby tray 41 to the processing tray 61.

Figure 7:
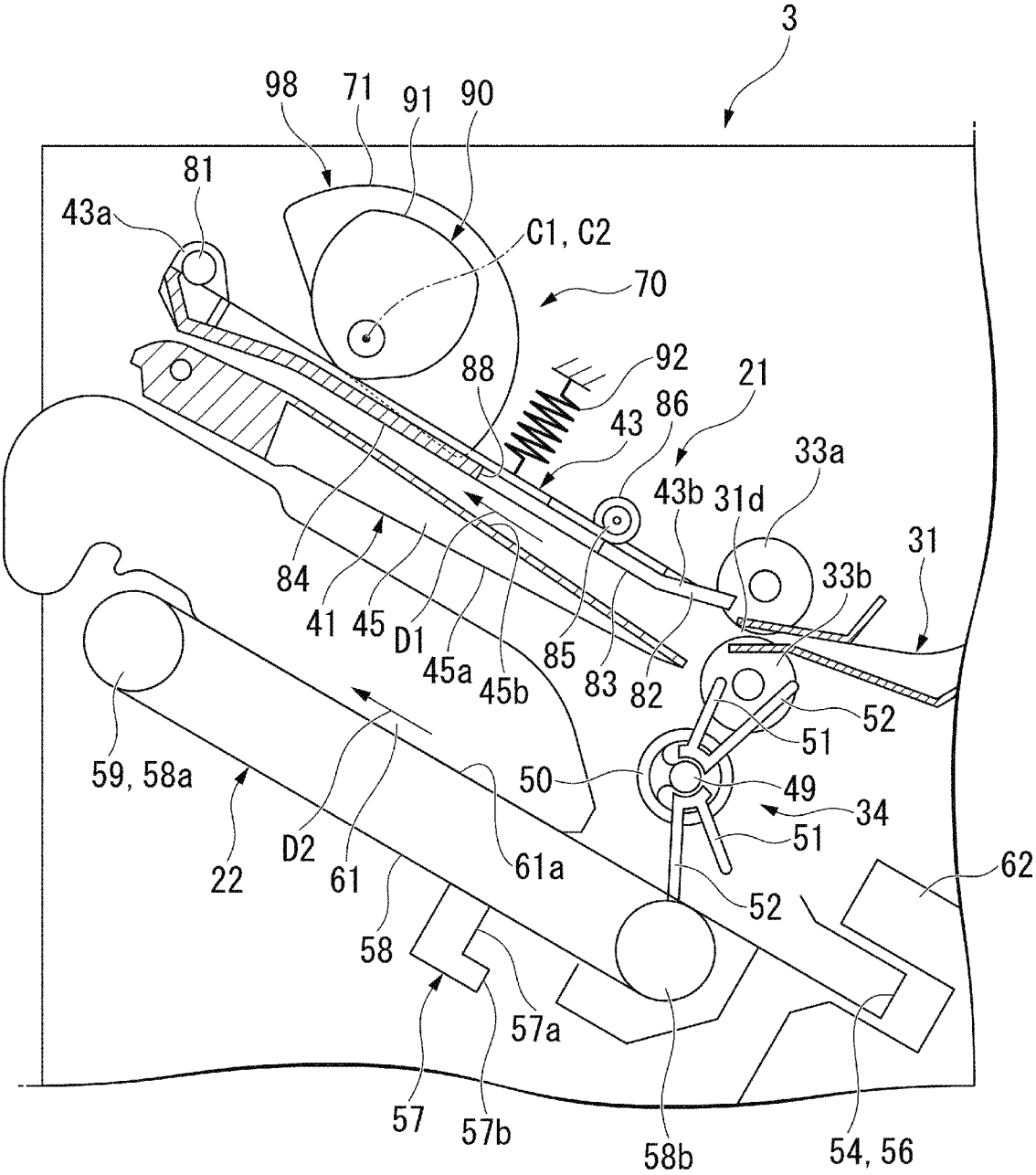
FIG. 7 illustrates a cross-sectional view of the standby unit and the processing unit according to the embodiment.

FIG. 7 illustrates the standby unit 21 and the processing unit 22 according to the embodiment.

As illustrated in FIG. 7, the assist guide 43 is provided above the standby tray 41. For example, the assist guide 43 has substantially the same length as the length of the standby tray 41 in the sheet conveying direction D1. The assist guide 43 is a plate-like member spreading above the standby tray 41 (refer to FIG. 8). The sheets S discharged from the sheet discharge port 31*d* of the conveying path 31 enter the gap between the assist guide 43 and the standby tray 41. The sheets S that entered the standby unit 21 are guided by the assist guide 43 and the standby tray 41, and transported to the downstream side of the standby unit 21.

Figure 9:
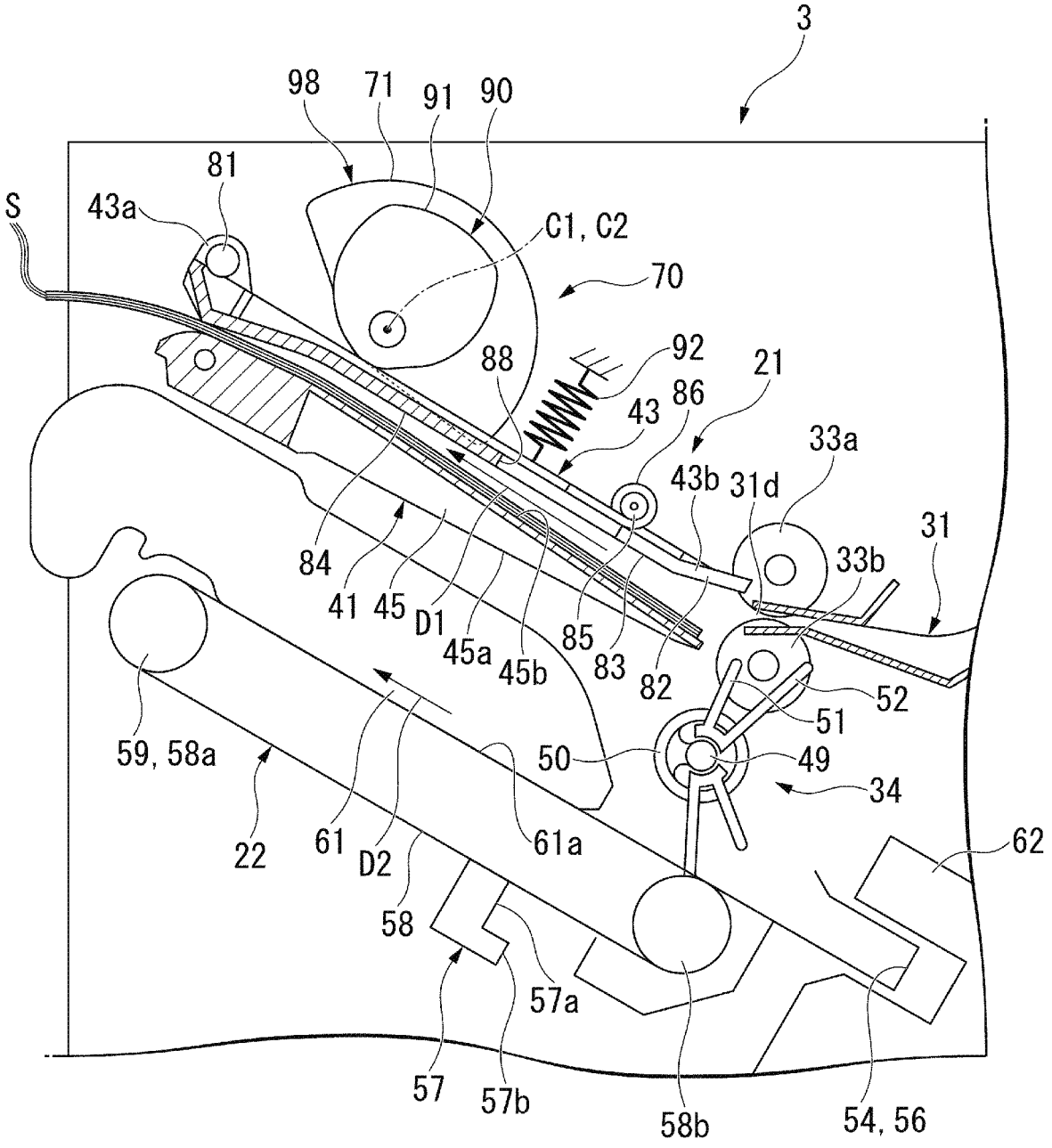
FIGS. 9-13 illustrate cross-sectional views of the standby unit and the processing unit to explain an operation example of the assist guide according to the embodiment.
Figure 10:
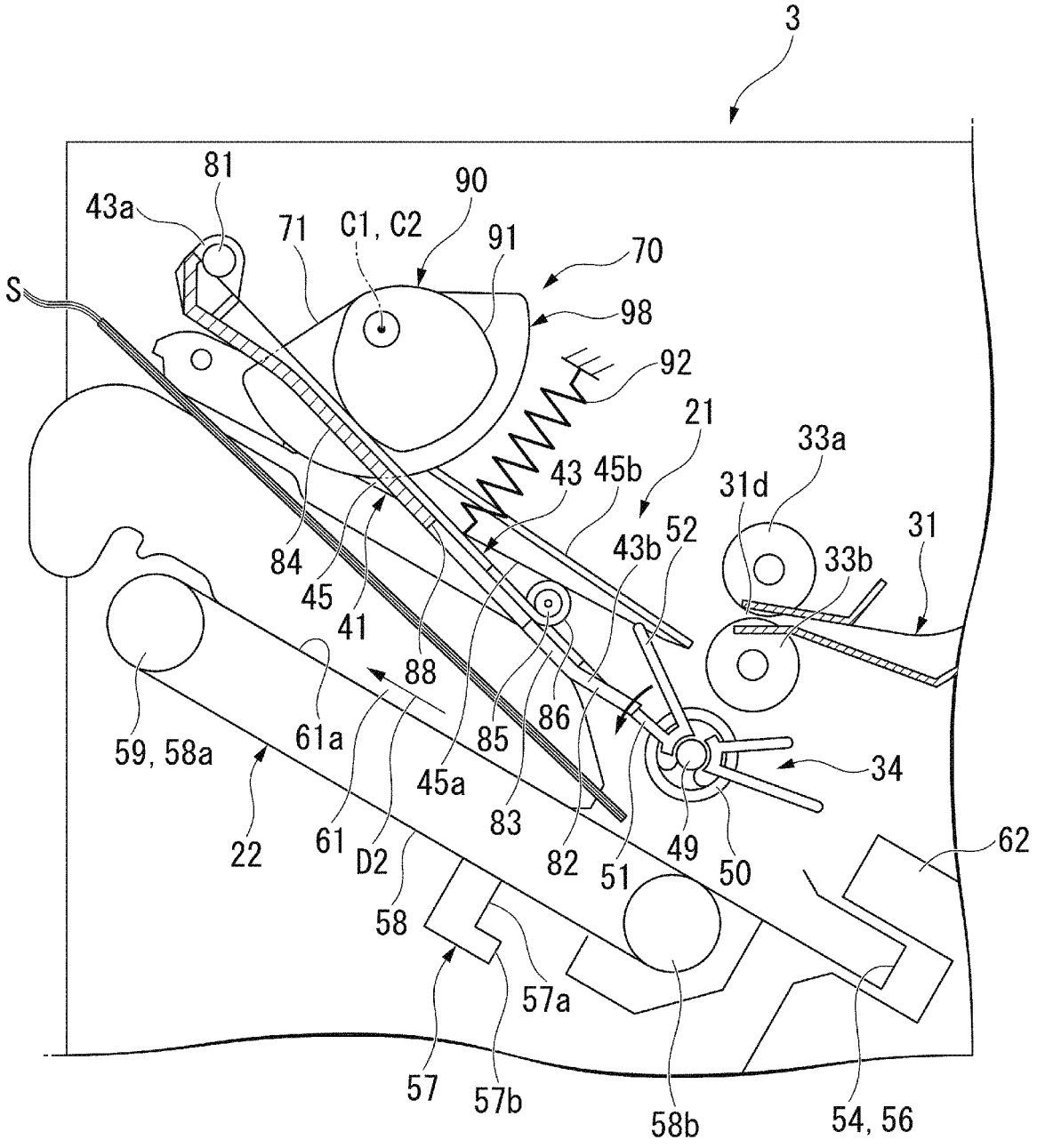

The assist guide 43 is movable between a standby position (refer to FIG. 9) and a dropping position moved downward with respect to the standby position (refer to FIG. 10). At the standby position, the entire assist guide 43 is located above the standby tray 41. At the standby position, the assist guide 43 is located to be upper than the sheet discharge port 31*d* of the conveying path 31. On the other hand, at the dropping position, at least a part of the assist guide 43 protrudes downward from the lower surface 45*a* of the bottom wall 45 of the standby tray 41. When the sheets S move from the standby tray 41 to the processing tray 61, the assist guide 43 moves from the standby position to the dropping position. The assist guide 43 can press the sheets S to the processing tray 61 by moving from the standby position to the dropping position.

Figure 12:
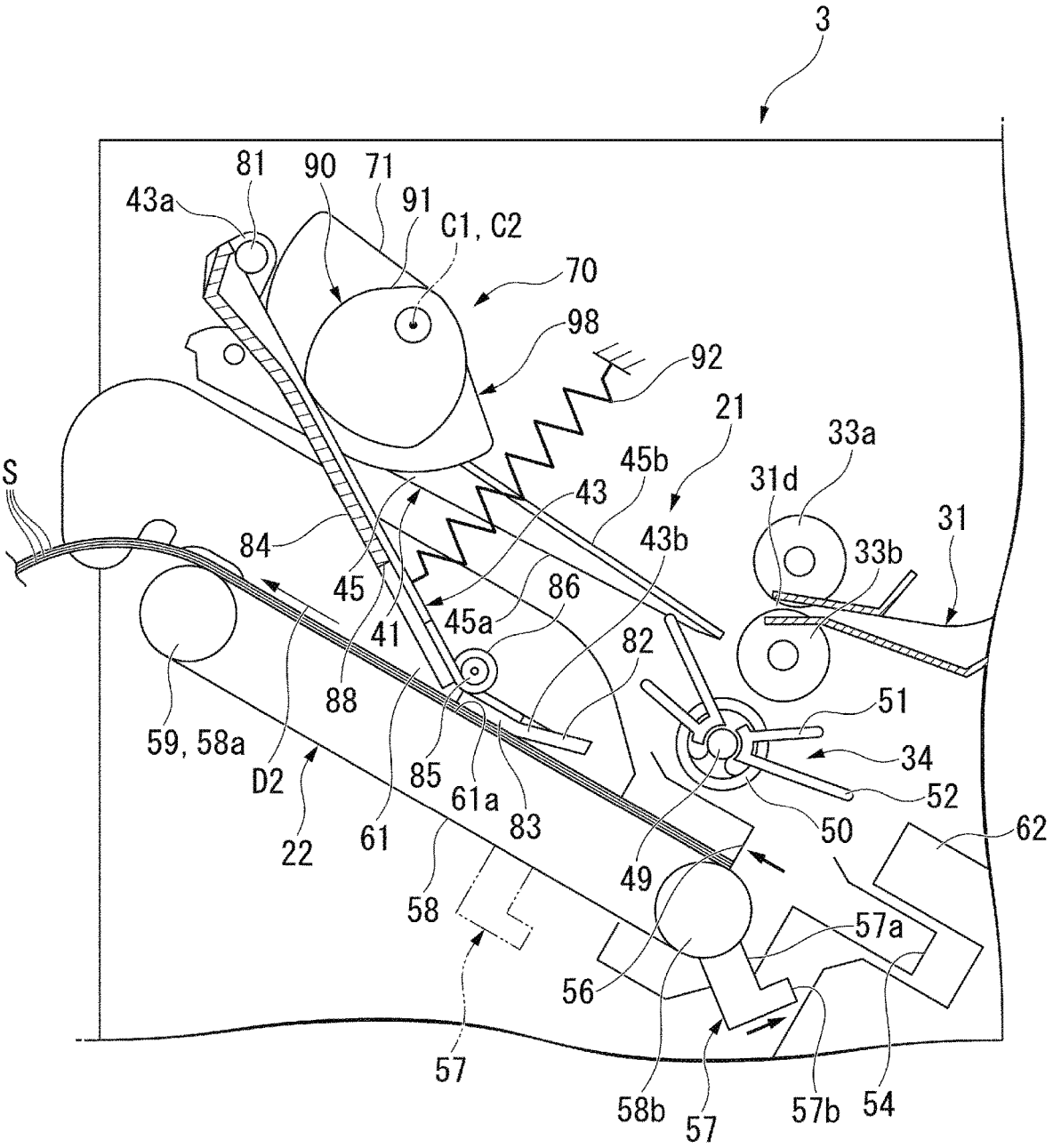

Further, the assist guide 43 is movable between the dropping position and a sheet pressing position downward with respect to the dropping position (refer to FIG. 12). That is, the assist guide 43 is movable between the standby position and the sheet pressing position. At the sheet pressing position, the assist guide 43 approaches or contacts the sheets S on the processing tray 61. The functions of the assist guide 43 will be described in detail below.

Next, the paddle unit 34 will be described.

The paddle unit 34 is provided between the standby tray 41 and the processing tray 61. The paddle unit 34 is provided below the standby tray 41. When the sheets S move from the standby tray 41 to the processing tray 61, the paddle unit 34 rotates around a rotating shaft 49 to hit the sheets S toward the processing tray 61. The paddle unit 34 moves the sheets S dropped onto the processing tray 61 to a predetermined position of the processing unit 22. The paddle unit 34 has the rotating shaft 49, a rotating body 50, plural first paddles 51, and plural second paddles 52.

The rotating shaft 49 is the center of rotation of the paddle unit 34. The rotating shaft 49 is located lower than the standby tray 41. The rotating shaft 49 extends in the sheet width direction W. The paddle unit 34 rotates around the rotating shaft 49 in a counterclockwise direction in FIG. 7.

The rotating body 50 is cylindrically formed. The rotating body 50 rotates around the rotating shaft 49. The rotating body 50 includes the first paddles 51 and the second paddles 52.

The first paddles 51 and the second paddles 52 protrude from the rotating body 50 in a radial direction of the rotating body 50. The first paddles 51 and the second paddles 52 are each formed of an elastic member such as rubber. For example, the first paddles 51 are rotated at a timing at which the sheets S move from the standby tray 41 to the processing tray 61. The first paddles 51 press the sheets S toward the processing tray 61 by the rotation. For that reason, even when the sheets S are attached to the assist guide 43 by static electricity or the like, the sheets S can be reliably peeled off from the assist guide 43.

The second paddles 52 are located behind the first paddles 51 in the rotation direction of the paddle unit 34. The length of each second paddle 52 is longer than that of each first paddle 51 in the radial direction of the rotating body 50. The second paddles 52 are rotated around the rotating shaft 49 to contact the upper surface of a sheet S, which is located at the uppermost position in the plural sheets S that are dropped on the processing tray 61. The second paddles 52 are further rotated in the state of being in contact with the upper surface of the sheet S, and thus move the sheet S toward a stapler 62.

Next, the processing unit 22 will be described.

The processing unit 22 has the processing tray 61, the stapler 62, an ejector 56, a bundle pawl 57, a bundle pawl belt 58, and a conveying roller 59.

The processing tray 61 is provided below the standby tray 41. The processing tray 61 is tilted with respect to the horizontal direction so as to gradually increase in height toward the downstream side of the sheet conveying direction D2. For example, the processing tray 61 is tilted substantially parallel to the standby tray 41. The processing tray 61 includes a conveying surface 61*a* on which the sheets S are placed. The conveying surface 61*a* is the upper surface of the processing tray 61. The conveying surface 61*a* supports the sheets S. For example, the plural sheets S moved to the processing tray 61 are aligned in the sheet width direction W and the sheet conveying direction D2 by an alignment plate or the like. For example, the processing unit 22 presses the bundle of sheets S moved from the standby tray 41 to the processing tray 61 to a trailing end stopper 54 that is provided at the back of the processing unit 22 on the upstream side.

The trailing end stopper 54 is disposed at the end of the processing tray 61 on the upstream side in the sheet conveying direction D2. For example, the shape of the trailing end stopper 54 is a hook-like shape. The trailing end stopper 54 supports the trailing edge of the sheets S placed on the processing tray 61. The trailing end stopper 54 supports the trailing edge of the bundle of sheets S and aligns the position of the trailing edge of the bundle of sheets S.

The stapler 62 is provided at the end of the processing tray 61 on the upstream side in the sheet conveying direction D2. The stapler 62 performs a stapling process on the bundle of sheets S which is supported by the trailing end stopper 54 to align the position of the trailing edge.

The ejector 56 is disposed at the end of the processing tray 61 on the upstream side in the sheet conveying direction D2. The ejector 56 is disposed to overlap with the trailing end stopper 54 when viewed from the sheet width direction W at the reference position. For example, the shape of the ejector 56 is a hook-like shape. For example, the ejector 56 supports the trailing edge of the bundle of sheets S which are placed on the processing tray 61 to be subjected to stapling process and a sorting process.

The ejector 56 moves in the sheet conveying direction D2. For example, the ejector 56 moves from the reference position toward the downstream side in the sheet conveying direction D2 by the driving force transmitted from a driving source. For example, when the driving force is blocked from the driving source, the ejector 56 moves to the reference position by the returning force applied from the elastic member toward the upstream side in the sheet conveying direction D2.

The ejector 56 moves from the upstream side to the downstream side in the sheet conveying direction D2 while supporting the trailing edge of the bundle of sheets S, the bundle of sheets S advances toward the downstream side in the sheet conveying direction D2. The ejector 56 moves the bundle of sheets S to the position to deliver the sheets to the bundle pawl 57.

The bundle pawl 57 is a pushing member for moving the sheets S placed on the processing tray 61 to the downstream side in the sheet conveying direction D2 by pushing. The bundle pawl 57 is fixed to the bundle pawl belt 58. The bundle pawl belt 58 is stretched over a pair of first and second belt rollers 58*a* and 58*b* that are disposed to be separated from each other in the sheet conveying direction D2. The first belt roller 58*a* is disposed on the downstream side from the second belt roller 58*b* in the sheet conveying direction D2. The first belt roller 58*a* is a driving roller and rotationally drives the bundle pawl belt 58. For example, the driving source of the first belt roller 58*a* is also the driving source of the ejector 56. The second belt roller 58*b* is a driven roller and rotated by the rotational driving force transmitted from the first belt roller 58*a* through the bundle pawl belt 58.

The bundle pawl 57 moves along with rotation of the bundle pawl belt 58. The bundle pawl 57 is provided so as to protrude from the outer peripheral surface of the bundle pawl belt 58 when viewed from the sheet width direction W. The bundle pawl 57 contacts with the trailing edge of the sheets S placed on the processing tray 61 and conveys the sheets S to push the sheets from the upstream side to the downstream side in the sheet conveying direction D2. The bundle pawl 57 includes a contact portion 57*a* which contacts the sheets S from the upstream side in the sheet conveying direction D2, and an eaves portion 57*b* that protrudes from the contact portion 57*a*. The contact portion 57*a* contacts the trailing edge of the sheets S on the upper surface side of the processing tray 61 (refer to FIG. 13). The upper surface side of the processing tray 61 is a side of the conveying surface 61*a*. On the upper surface side of the processing tray 61, a height H of the contact portion 57*a* (refer to FIG. 13) with respect to the conveying surface 61*a* corresponds to an upper limit of the thickness of the sheets S to be conveyed by the bundle pawl 57. The eaves portion 57*b* is provided on a side opposite to the bundle pawl belt 58 with the contact portion 57*a* interposed therebetween. The eaves portion 57*b* protrudes from the contact portion 57*a* to the downstream side in the sheet conveying direction D2 on the upper surface side of the processing tray 61. Thus, the eaves portion 57*b* defines the height H of the contact portion 57*a* with respect to the conveying surface 61*a* of the processing tray 61. The eaves portion 57*b* restricts the upward movement of the trailing end of the sheets S contacting the contact portion 57*a*.

The bundle pawl 57 can stay at a position in front of the second belt roller 58*b* in a direction opposite to the sheet conveying direction D2 as a home position on a lower surface side of the processing tray 61. Whether or not the bundle pawl 57 is at the home position is detected by a sensor.

For example, the bundle pawl 57 moves from the home position to the second belt roller 58*b* on the lower surface side of the processing tray 61 with the forward rotation of the bundle pawl belt 58. The forward rotation of the bundle pawl belt 58 is a counterclockwise rotation in FIG. 7. The bundle pawl 57 moves from the lower surface side of the processing tray 61 to the upper surface side of the processing tray 61 along the outer periphery of the second belt roller 58*b*. The bundle pawl 57 receives the sheets S from the ejector 56 and moves in the sheet conveying direction D2 on the upper surface side of the processing tray 61. That is, the bundle pawl 57 conveys the sheets S placed on the processing tray 61 in a region on the downstream side than a conveying region by the ejector 56. While conveying the sheets S, the bundle pawl 57 moves to the lower surface side of the processing tray 61 along the outer periphery of the first belt roller 58*a*. The bundle pawl 57 pushes the sheets S toward the downstream side to discharge the sheets.

For example, after discharging the sheets S, the bundle pawl 57 moves to the upstream side in the sheet conveying direction D2 on the upper surface side of the processing tray 61 with the reverse rotation of the bundle pawl belt 58. The bundle pawl 57 moves from the upper surface side to the lower surface side of the processing tray 61 along outer periphery of the second belt roller 58*b* and returns to the home position.

The conveying roller 59 is disposed to overlap with the first belt roller 58*a* when viewed from the sheet width direction W. The conveying roller 59 rotates in a clockwise direction in FIG. 7 to convey the sheets S placed on the processing tray 61 to the trailing end stopper 54. Thus, the sheets S placed on the processing tray 61 are conveyed to the stapler 62. The conveying roller 59 conveys the sheets S placed on the processing tray 61 in the sheet conveying direction D2. Thus, the sheets S placed on the processing tray 61 are discharged from the discharge unit 23.

Next, the dropping mechanism 70 for dropping the sheets S will be described in detail.

The post-processing apparatus 3 has the dropping mechanism 70 for stably dropping the sheets S from the standby tray 41 to the processing tray 61. Specifically, the dropping mechanism 70 has a pressing member 71 and a driving mechanism 90, in addition to the above-described assist guide 43.

First, the assist guide 43 will be described.

As described above, the assist guide 43 is movable between the standby position and the sheet pressing position. When the sheets S move from the standby tray 41 to the processing tray 61, the assist guide 43 moves from the standby position to a dropping position. The assist guide 43 moves from the standby position to the dropping position, thereby pressing the trailing end of the sheets S toward the processing tray 61. Further, when the sheets S are conveyed by the bundle pawl 57 or the ejector 56, the assist guide 43 moves from the standby position or the dropping position to the sheet pressing position. The sheet pressing position is a position at which the assist guide 43 is at the height or lower of the contact portion 57*a* of the bundle pawl 57 with respect to the conveying surface 61*a* of the processing tray 61 (refer to FIG. 13). The assist guide 43 is located at the sheet pressing position, thereby contacting the upper surface of the sheets S.

The assist guide 43 has a first end 43*a* and a second end 43*b* in the sheet conveying direction D1. The first end 43*a* is an end on the downstream side in the sheet conveying direction D1. The first end 43*a* has a pivot shaft 81, which is the center of rotation of the assist guide 43. For example, the pivot shaft 81 is located on the downstream side from the pressing member 71. The second end 43*b* is an end on the upstream side in the sheet conveying direction D1. In a case of moving from the standby position to the dropping position, the second end 43*b* forms a pressing portion 82 which is in contact with the sheets S.

The assist guide 43 is formed to be bendable between the first end 43*a* and the second end 43*b*. The assist guide 43 includes a leading end 83 including the first end 43*a*, and a support portion 84 including the second end 43*b*. The leading end 83 and the support portion 84 are formed by dividing the assist guide 43 in the sheet conveying direction D1. The support portion 84 supports the leading end 83 to be displaceable upward. For example, the support portion 84 supports the leading end 83 through a connecting member 85 such as a hinge. The leading end 83 is rotated around an axis extending in the sheet width direction W with respect to the support portion 84. The assist guide 43 has a state in which the leading end 83 and the lower surface of the support portion 84 are flush with each other when viewed from the sheet width direction W as a reference state. The leading end 83 is rotated upward with respect to the support portion 84 from the position of the reference state.

The assist guide 43 further includes an urging member 86 for urging the leading end 83 downward against the support portion 84. The urging member 86 urges the leading end 83 downward against the support portion 84. Thus, the leading end 83 of the assist guide 43 is elastically displaceable from the reference state with respect to the support portion 84. For example, the urging member 86 is a torsion coil spring mounted on a connecting member 85 connecting the leading end 83 and the support portion 84. The urging member may be a leaf spring or the like.

Figure 8:
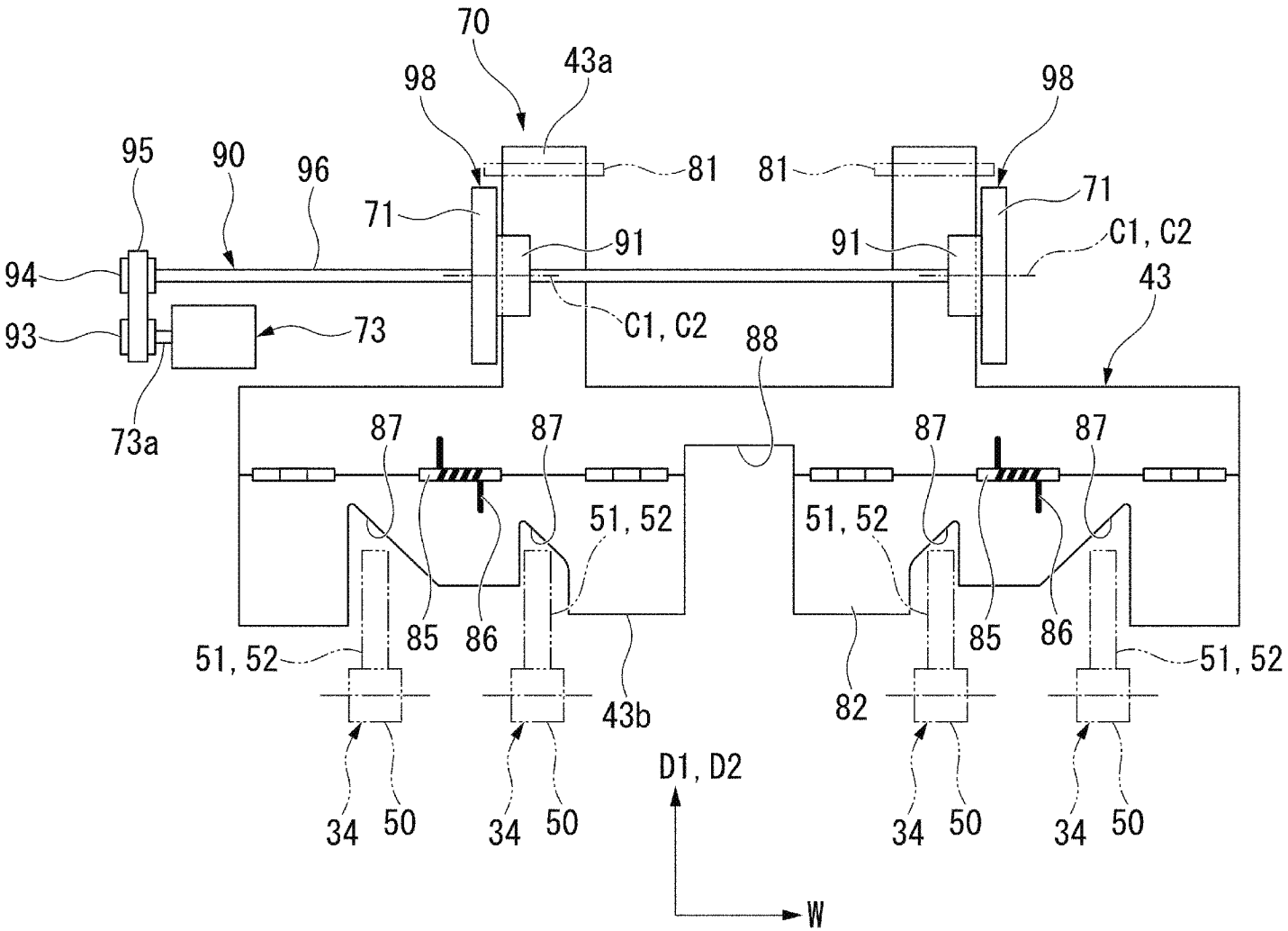
FIG. 8 illustrates a plan view of an assist guide and a dropping mechanism according to the embodiment.

FIG. 8 illustrates the assist guide 43 and the dropping mechanism 70 according to the embodiment.

As illustrated in FIG. 8, the width of the second end 43*b* in the sheet width direction W is larger than the width of the first end 43*a* in the sheet width direction W. For example, the second end 43*b* has a width large enough to cover the trailing end of the sheets S of plural types of standards (for example, postcard size, B5 size, and A4 size).

At the second end 43*b*, plural notches 87 and 88 are provided. The notches 87 and 88 extend from the trailing edge of the second end 43*b* to the sheet conveying direction D1. The notches 87 are formed at the positions corresponding to the first paddles 51 and the second paddles 52 of the paddle unit 34. The first paddles 51 and the second paddles 52 of the paddle unit 34 can press the sheets S without contacting the assist guide 43 by passing through the notches 87 of the second end 43*b*. In other words, the assist guide 43 extends to the upstream side in the sheet conveying direction D1 by at least part of the rotational loci of the first paddles 51 and the second paddles 52. Therefore, the assist guide 43 of the embodiment can press the trailing end of the sheets S towards the processing tray 61. When the assist guide 43 can press the trailing end of the sheets S, it is possible to stably move downward the trailing ends of the sheets S, which often have a curl. The notches 88 are formed at the position corresponding to the bundle pawl 57 (refer to FIG. 7). The bundle pawl 57 can convey the sheets S without contacting the assist guide 43 by passing through the notches 88 of the second end 43*b*.

Next, the pressing member 71 will be described.

As illustrated in FIG. 7, the pressing member 71 is provided above the standby tray 41. In the embodiment, the pressing member 71 is located between the pivot shaft 81 and the pressing portion 82 of the assist guide 43 in the sheet conveying direction D1. The pressing member 71 is movable between the standby position (refer to FIG. 9) and a protruding position (refer to FIG. 10). At the standby position, the entire pressing member 71 is located above the standby tray 41. At the protruding position, the pressing member 71 protrudes at least to substantially the same position as the lower surface 45*a* of the standby tray 41. The pressing member 71 moves from the standby position to the protruding position when the sheets S move from the standby tray 41 to the processing tray 61. The pressing member 71 moves from the standby position to the protruding position to protrude downward at least from a part of the assist guide 43. Thus, the pressing member 71 can press the sheets S toward the processing tray 61.

For example, the pressing member 71 is a first cam (large cam). The pressing member 71 has a rotation center C1 located above the standby tray 41. The pressing member 71 is a cam having an outer peripheral surface eccentric with respect to the rotation center C1. For example, the pressing member 71 is a fan-shaped cam smaller than a half circle. The pressing member 71 is movable between the standby position and the protruding position by being rotated around the rotation center C1.

As illustrated in FIG. 8, the pressing member 71 is provided at a position not overlapping with the assist guide 43 when viewed from the vertical direction. Thus, the pressing member 71 can protrude under the assist guide 43 without being disturbed by the guide 43. The pressing member 71 is provided at plural positions (for example, two positions) in the sheet width direction W.

Next, the driving mechanism 90 will be described.

As illustrated in FIGS. 7 and 8, the driving mechanism 90 drives the assist guide 43. The driving mechanism 90 has a driving member 91, a spring 92, a driving pulley 93, a driven pulley 94, a driving belt 95, and a connecting shaft 96.

As illustrated in FIG. 7, the driving member 91 is a member which moves the assist guide 43 from the standby position to the sheet pressing position. For example, the driving member 91 is a second cam (small cam). The driving member 91 has a rotation center C2 located above the standby tray 41. The driving member 91 is a cam having an outer peripheral surface eccentric with respect to the rotation center C2. The driving member 91 is rotated around the rotation center C2 to contact the upper surface of the assist guide 43. The driving member 91 is further rotated in a state in which the driving member 91 is in contact with the upper surface of the assist guide 43 to press the assist guide 43 downward. Thus, the driving member 91 moves the assist guide 43 from the standby position to the sheet pressing position.

As illustrated in FIG. 8, the driving member 91 is provided at a position overlapping with the assist guide 43 when viewed from the vertical direction. The driving member 91 is provided at plural positions (for example, two positions) in the sheet width direction W. The driving member 91 is provided adjacent to the pressing member 71. For example, the rotation center C2 of the driving member 91 and the rotation center C1 of the pressing member 71 are provided coaxially. Both the driving member 91 and the pressing member 71 are fixed to the connecting shaft 96. Therefore, the driving member 91 and the pressing member 71 rotate integrally with each other. In the following description, for convenience of description, one in which the driving member 91 and the pressing member 71 are regarded as being integrally formed is referred to as "rotating member 98".

As illustrated in FIG. 7, the spring 92 is provided above the assist guide 43. The spring 92 urges the assist guide 43 upward. Therefore, the assist guide 43 moved downward from the standby position returns to the standby position when the pressing force by the driving member 91 is released.

As illustrated in FIGS. 5 and 8, the driving pulley 93 is connected to a driving shaft 73*a* of a driving source 73. For example, the driving source 73 is a motor. The driven pulley 94 is provided in parallel with the driving pulley 93. The driving belt 95 is stretched over the driving pulley 93 and the driven pulley 94. A first end of the connecting shaft 96 is connected to the driven pulley 94. A second end of the connecting shaft 96 is connected to the pressing member 71 and the driving member 91. Further, the connecting shaft 96 connects the pair of rotating members 98 to each other. Thus, when the drive shaft 73*a* of the drive source 73 rotates, the rotation members 98 rotate. When the rotation members 98 rotate, the assist guide 43 and the pressing member 71 move to the processing tray 61.

Next, the flow of the operation of the post-processing apparatus 3 will be described.

FIG. 9 illustrates a state where the sheets S entered the standby tray 41.

In this case, the assist guide 43 is located at the standby position. That is, the assist guide 43 and pressing member 71 are located above the standby tray 41.

FIG. 10 illustrates a state where the sheets S are moving from the standby tray 41 to the processing tray 61.

In this case, the assist guide 43 moves from the standby position to the dropping position. Further, the pressing member 71 moves from the standby position to the protruding position. The post-processing control unit 24 rotates the driving shaft 73*a* of the driving source 73. When the drive shaft 73*a* of the drive source 73 rotates, the driving member 91 and the pressing member 71 rotate in accordance with the rotation of the driving shaft 73*a*. When the driving member 91 rotates, the assist guide 43 is pressed downward. The downwardly pressed assist guide 43 presses the trailing end of the sheets S toward the processing tray 61 by rotating around the pivot shaft 81. At this time, the pressing portion 82 of the assist guide 43 descends in a direction perpendicular to the conveying surface 61*a* of the processing tray 61 to substantially the same position as the rotating shaft 49 of the paddle portion 34. When the pressing member 71 rotates, the pressing member 71 protrudes downward from at least a part of the assist guide 43. Thus, the pressing member 71 presses the sheets S towards the processing tray 61.

Figure 11:
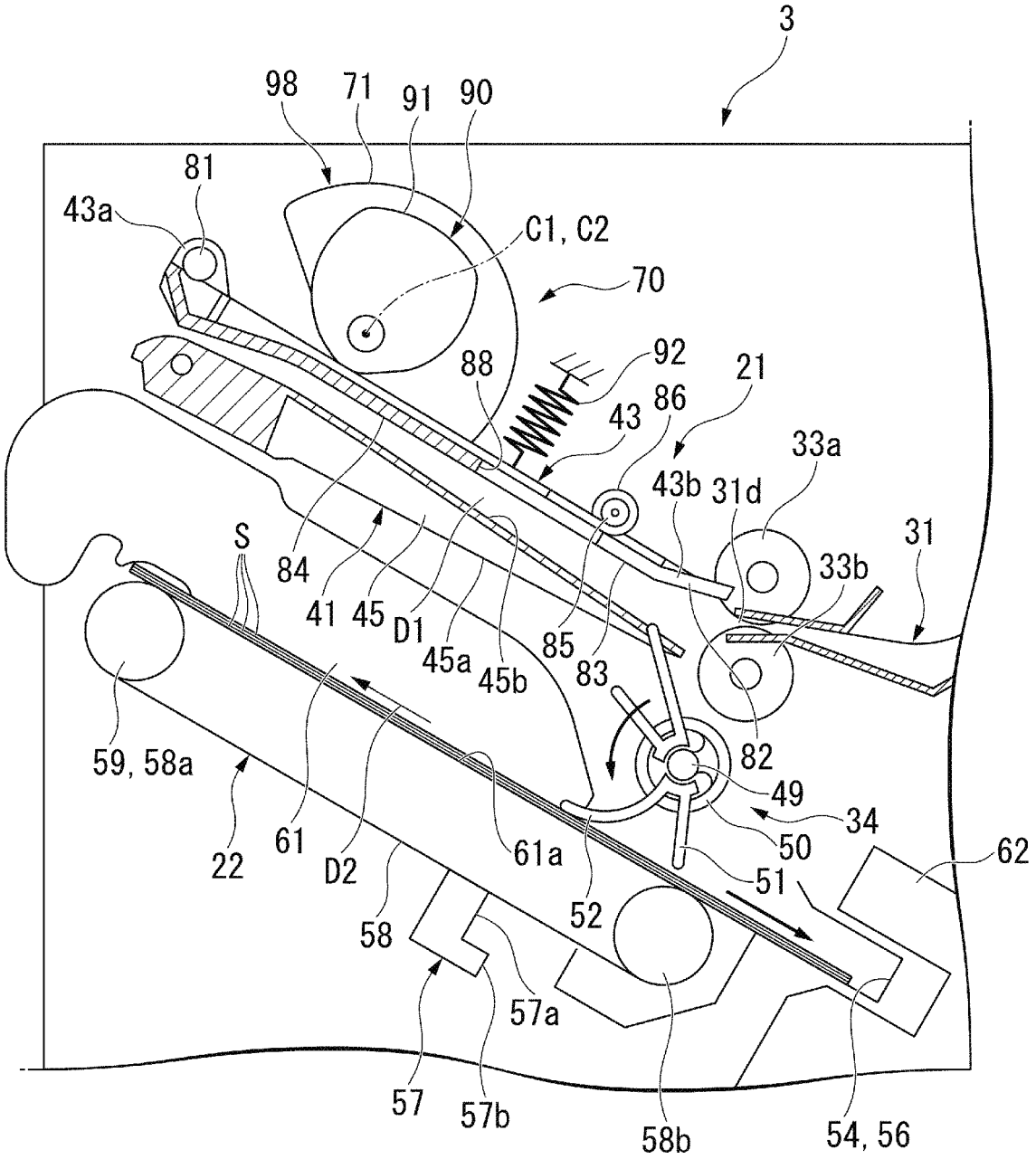

FIG. 11 illustrates a state where the sheets S placed on the processing tray 61 are being conveyed to the stapler 62.

As illustrated in FIG. 11, when the sheets S are dropped onto the processing tray 61, the paddle unit 34 is rotated. Thus, for example, the sheets S on the processing tray 61 are sent to the stapler 62 by the second paddles 52. In this case, the conveying roller 59 is driven to send the sheets S to the stapler 62. Thus, the sheets S on the processing tray 61 are sent to the stapler 62. At this time, for example, the assist guide 43 is at the standby position.

When the sheets S placed on the processing tray 61 are discharged to the movable tray 23*b* of the discharge unit 23 (refer to FIG. 1), the post-processing control unit 24 changes processing according to the state of the sheets S. For example, the state of the sheets S includes the number of bundles of sheets S, the shape of the sheet S, the type of the sheet S, and the like. The shape of the sheet S is the length and thickness in the sheet conveying direction D2, and the like. The type of the sheet S is paper quality, weight, and the like. The post-processing control unit 24 acquires information on selection of discharge processing in response to the operation of the user on the control panel 11.

When a predetermined condition is satisfied, the post-processing control unit 24 moves the assist guide 43 to the sheet pressing position. The predetermined condition is a condition in which buckling is likely to occur in the sheets S pushed by the bundle pawl 57. For example, when the number of bundles of sheets S is equal to or less than a predetermined number, the post-processing control unit 24 moves the assist guide 43 to the sheet pressing position. For example, when the length of the sheet S in the sheet conveying direction D2 is longer than a predetermined length, the post-processing control unit 24 moves the assist guide 43 to the sheet pressing position. For example, when the thickness of the sheet S is thinner than a predetermined thickness, the post-processing control unit 24 moves the assist guide 43 to the sheet pressing position. For example, when the sheet S is of a type that does not have a predetermined stiffness (difficulty of deflection), the post-processing control unit 24 moves the assist guide 43 to the sheet pressing position.

Figure 13:
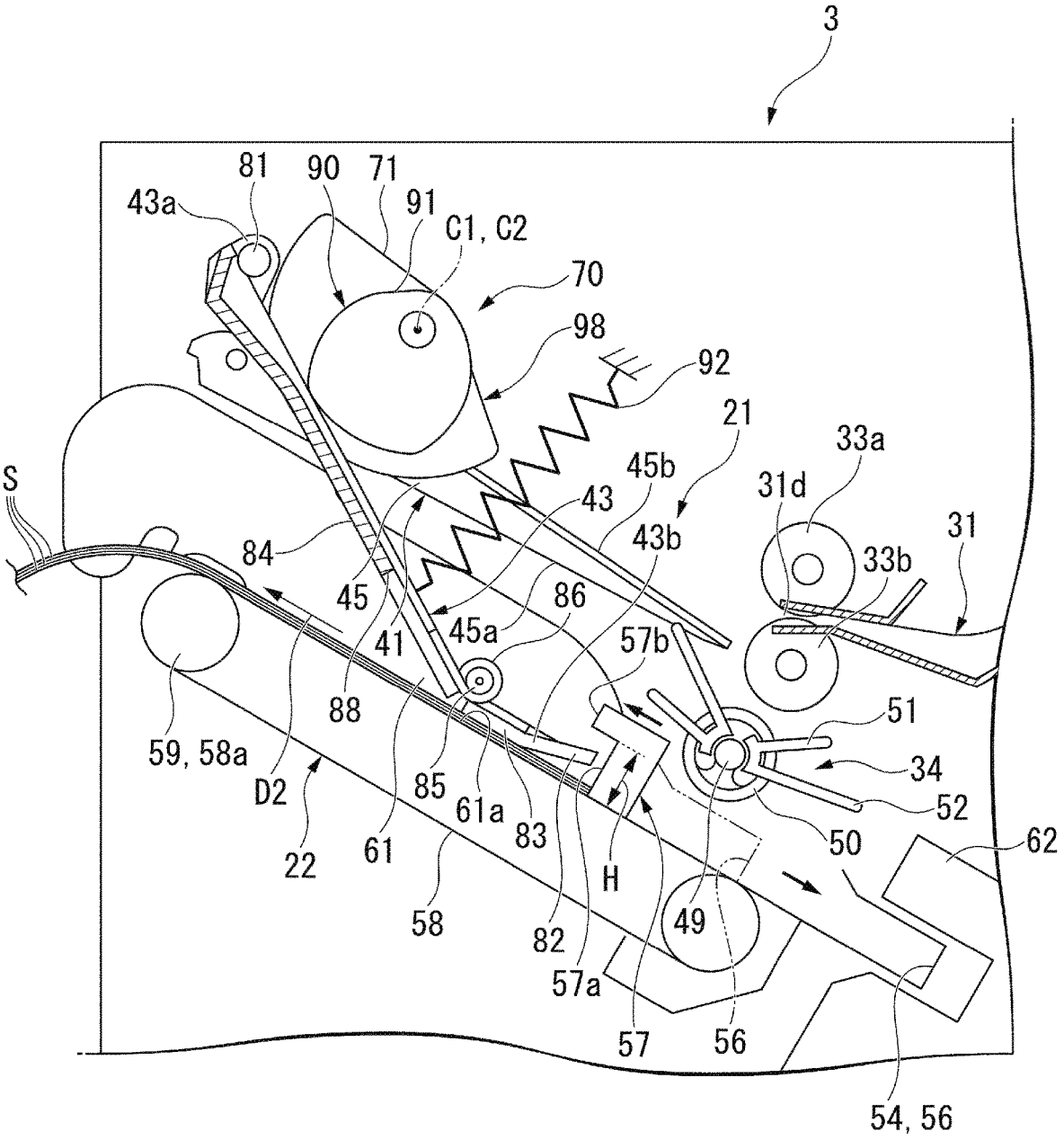

FIGS. 12 and 13 illustrate states where the sheets S placed on the processing tray 61 are being conveyed to the discharge unit.

As illustrated in FIG. 12, when the sheets S placed on the processing tray 61 are conveyed, the assist guide 43 moves to the sheet pressing position. At the sheet pressing position, the assist guide 43 advances to the height H or lower of the contact portion 57*a* of the bundle pawl 57 with respect to the conveying surface 61*a* of the processing tray 61 (refer to FIG. 13). At the sheet pressing position, the assist guide 43 contacts the upper surface of the sheets S. At this time, the leading end 83 of the assist guide 43 is displaced upward with respect to the support portion 84. The post-processing control unit 24 changes the sheet pressing position according to the number of bundles of sheets S. The post-processing control unit 24 brings the lower surface of the leading end 83 of the assist guide 43 into contact the upper surface of the sheets S by changing the sheet pressing position.

The post-processing control unit 24 advances to the ejector 56 and the bundle pawl 57 in order to convey the bundle of sheets S in the sheet conveying direction D2. The post-processing control unit 24 moves the ejector 56 from the reference position in the sheet conveying direction D2. When contacting the trailing edge of the bundle of sheets S, the ejector 56 pushes the bundle of sheets S in the sheet conveying direction D2. The bundle pawl 57 moves to the upper surface side of the processing tray 61 from the home position.

As illustrated in FIG. 13, the bundle pawl 57 contacts the trailing edge of the bundle of sheets S on the upper surface side of the processing tray 61 and receives the bundle of sheets S from the ejector 56. The ejector 56 returns to the reference position. The bundle pawl 57 pushes the trailing edge of the received bundle of sheets S from the upstream side to the downstream side in the sheet conveying direction D2 to convey the bundle of sheets S.

At this time, the upward displacement of the bundle of sheets S is regulated by the assist guide 43 on the side opposite towards the conveying surface 61*a* of the processing tray 61. Thus, the bundle of sheets S is prevented from buckling in the middle part in the sheet conveying direction D2 by the trailing end being pushed by the bundle pawl 57.

The bundle pawl 57 passes through the notches 88 of the assist guide 43 located at the sheet pressing position during the process of conveying the bundle of sheets S. Thus, the bundle pawl 57 conveys the bundle of sheets S pressed by the assist guide 43 without contacting the assist guide 43. After the bundle pawl 57 passes through the sheet pressing position of the assist guide 43, the post-processing control unit 24 retracts the assist guide 43 from the sheet pressing position. That is, after the bundle pawl 57 passes through the notches 88, the post-processing control unit 24 moves the assist guide 43 from the sheet pressing position to the standby position. In other words, when the contact of the assist guide 43 to the trailing edge of the sheets S is completed, the post-processing control unit 24 moves the assist guide 43 from the sheet pressing position to the standby position.

In the post-processing apparatus 3 of the above-described embodiment, the assist guide 43 moves to the sheet pressing position when the sheets S placed on the processing tray 61 are conveyed by the bundle pawl 57. At the sheet pressing position, the assist guide 43 advances to the height H or lower of the contact portion 57*a* of the bundle pawl 57 with respect to the conveying surface 61*a* of the processing tray 61 above the sheet S. According to this configuration, the assist guide 43 can prevent the sheets S from being displaced upward and separated from the conveying surface 61*a* of the processing tray 61. Thus, it is possible to prevent buckling of the sheets S pushed by the bundle pawl 57. Therefore, it is possible to improve the discharge stability of the sheets S.

The assist guide 43 includes the leading end 83 and the support portion 84. The leading end 83 contacts the upper surface of the sheets S placed on the processing tray 61. The support portion 84 supports the leading end 83 to be displaceable upward. According to this configuration, by displacing the leading end 83 according to the thickness of the bundle of sheets S, it is possible to offset changes in the distance between the upper surface of the sheets S and the assist guide 43. Thus, a gap is formed between the sheets S and the assist guide 43, thereby preventing the buckling of the sheets S. Further, it is possible to prevent the sheets S from being scratched by the assist guide 43 biting the sheets S.

The assist guide 43 further includes the urging member 86 for urging the leading end 83 downward against the support portion 84. According to this configuration, it is possible to prevent the leading end 83 from fluttering and to prevent the buckling of the sheets S by the leading end 83.

The assist guide 43 comes into surface contact with the upper surface of the sheets S at the sheet pressing position. According to this configuration, as compared with a case where the assist guide comes into point contact with the sheets S, the assist guide 43 can contact the sheets S in a wider range in the sheet conveying direction D2. Thus, it is possible to prevent the buckling of the sheets S pushed by the bundle pawl 57 in a wider range.

Further, as compared with a case where the assist guide comes into point contact with the sheets S, it is possible to reduce the contact pressure with respect to the sheets S. Thus, it is possible to prevent the sheets S from being scratched by the assist guide 43 biting the sheets S.

Further, the post-processing control unit 24 changes the sheet pressing position according to the number of bundles of sheets S conveyed by the bundle pawl 57. Thus, the assist guide 43 can be placed at a proper position according to the thickness of the sheets S. Therefore, a gap is formed between the sheets S and the assist guide 43, thereby preventing the buckling of the sheets S. Further, it is possible to prevent the sheets S from being scratched by the assist guide 43 biting the sheets S.

Further, when the number of sheets S conveyed by the bundle pawl 57 is equal to or less than a predetermined number, the post-processing control unit 24 controls the assist guide 43 to advance to the sheet pressing position. Thus, when the number of sheets S is relatively small and buckling cannot be prevented only with the weight of the sheets S, buckling can be prevented by the assist guide 43.

Further, when the shape of sheets S conveyed by the bundle pawl 57 satisfies a predetermined condition, the post-processing control unit 24 controls the assist guide 43 to advance to the sheet pressing position. Thus, when buckling is likely to occur, such as a case where the sheet S is long in the sheet conveying direction D2, a case where the sheet S is thin, and the like, buckling can be prevented by the assist guide 43.

Further, when the sheets S move from the standby tray 41 to the processing tray 61, the assist guide 43 moves from the standby position to the dropping position. The assist guide 43 moves from the standby position to the dropping position and presses the sheets S toward the processing tray 61. According to this configuration, the assist guide 43 can stably move the sheets S from the standby tray 41 to the processing tray 61. A member for moving the sheets S from the standby tray 41 to the processing tray 61 can be used as a member for preventing the buckling of the sheets S placed on the processing tray 61. Accordingly, as compared with a case where these members are separately provided, the post-processing apparatus 3 can be downsized and the cost thereof can be lowered.

The post-processing control unit 24 retracts the assist guide 43 from the sheet pressing position after the bundle pawl 57 passes through the sheet pressing position of the assist guide 43. Thus, the assist guide 43 can press the sheets S until the trailing end of the sheets S passes through the sheet pressing position. Accordingly, it is possible to further improve the discharge stability of the sheets S.

Hereinafter, a modified example of the post-processing apparatus 3 will be described.

In the post-processing apparatus 3 according to the above embodiment, the post-processing control unit 24 retracts the assist guide 43 from the sheet pressing position after the bundle pawl 57 passes through the sheet pressing position of the assist guide 43. However, the post-processing control unit 24 may retract the assist guide 43 from the sheet pressing position before the bundle pawl 57 passes through the sheet pressing position of the assist guide 43. Thus, the next action related to the assist guide 43 can be started earlier. That is, the standby tray 41 is prepared to receive the sheets S by disposing the assist guide 43 in the standby position more quickly. Accordingly, the processing speed of the post-processing apparatus 3 can be improved. In this case, the notches 88 may not be formed in the assist guide 43.

In the embodiment of the assist guide 43, the notches 88 are formed to avoid the bundle pawl 57, but the embodiment is not limited thereto. For example, the assist guide may be divided in the sheet width direction W to avoid the bundle pawl 57.

Further, the assist guide 43 according to the above embodiment includes the urging member 86 for urging the leading end 83 downward against the support portion 84, but the embodiment is not limited thereto. The assist guide may be formed so that only the own weight acts on the leading end.

The assist guide 43 according to the above embodiment is formed to be bendable by providing the leading end 83 and the support portion 84, but the embodiment is not limited thereto. That is, the assist guide may be undeformably formed from the first end to the second end. In this case, the assist guide does not necessarily have to contact the upper surface of the sheets S at the sheet pressing position. The assist guide may advance to the position at the height H or lower of the contact portion 57*a* of the bundle pawl 57 with respect to the conveying surface 61*a* of the processing tray 61. Thus, the assist guide may not be largely separated from the upper surface of the sheets S conveyed by the bundle pawl 57 at the sheet pressing position. Thus, the above-described effect can be exhibited.

In the post-processing apparatus 3 according to the above embodiment, when the sheets S are subjected to post-processing, as illustrated in FIG. 11, the assist guide 43 waits at the standby position, but the embodiment is not limited thereto. When the sheets S are subjected to post-processing, the assist guide 43 may wait at the dropping position.

In the post-processing apparatus 3 according to the above embodiment, the sheets S to be conveyed to the processing unit 22 are temporarily retained in the standby unit 21, but the embodiment is not limited thereto. The sheets S discharged from the discharge port 31*d* of the conveying path 31 may be directly conveyed to the processing unit 22 without passing through the standby unit 21.

In the embodiment, as an image processing system including the post-processing apparatus 3, the image forming system 1 having the image forming apparatus 2 is exemplified. However, the embodiment is not limited thereto. The image processing system including the post-processing apparatus 3 may include a decoloring device for performing a decoloring process on a sheet on which an image is formed.

According to at least one embodiment described above, the assist guide moves to the sheet pressing position when conveying the sheets placed on the processing tray by the bundle pawl. At the sheet pressing position, the assist guide advances to the height or lower of the contact portion of the bundle pawl with respect to the conveying surface of the processing tray above the sheet S. According to this configuration, the assist guide can prevent the sheet from being displaced upward to be separated from the conveying surface of the processing tray. Thus, it is possible to prevent buckling of the sheets pushed by the bundle pawl. Therefore, it is possible to improve the discharge stability of the sheets S.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet processing apparatus comprising:

a processing tray on which one or more sheets to be processed are placeable for sheet processing;

a pushing member configured to push an edge of the one or more sheets on the processing tray on an upstream side in a sheet conveying direction, by moving along a surface of the processing tray in the sheet conveying direction; and a movable guide movable to a sheet pressing position at which a distance between the surface of the processing tray and the movable guide is equal to or less than a height of the pushing member above the surface of the processing tray, wherein the movable guide is at the sheet processing position when the pushing member moves along the surface of the processing tray in the sheet conveying direction, and the movable guide includes a support portion and an end portion coupled to the support portion and rotatable around the support portion, wherein the end portion of the movable guide is located closest to the surface of the processing tray when the movable guide is at the sheet processing position.

2. The sheet processing apparatus according to claim 1, wherein the movable guide further includes an urging member that urges the end portion towards the processing tray with respect to the support portion.

3. The sheet processing apparatus according to claim 2, wherein the support portion of the movable guide is rotatable around a rotational axis at an end of the support portion opposite to an end of the support portion coupled to the end portion, and the movable guide further includes a second urging member that urges the support portion apart from the processing tray.

4. The sheet processing apparatus according to claim 3, further comprising:

a cam rotatable around a rotational axis and configured to change position of the movable guide according to rotation thereof.

5. The sheet processing apparatus according to claim 1, wherein the movable guide contacts an upper surface of a top sheet of the one or more sheets at the sheet pressing position.

6. The sheet processing apparatus according to claim 1, further comprising:

a controller configured to change the sheet pressing position of the movable guide based on the number of the one or more sheets.

7. The sheet processing apparatus according to claim 1, further comprising:

a controller configured to cause the movable guide to move to the sheet pressing position when the number of the one or more sheets is less than a predetermined number.

8. The sheet processing apparatus according to claim 1, further comprising:

a controller configured to cause the movable guide to move to the sheet pressing position when a size of the one or more sheets satisfies a predetermined condition.

9. The sheet processing apparatus according to claim 1, wherein the movable guide is at a position at which the distance between the surface of the processing tray and the movable guide is greater than the height of the pushing member above the surface of the processing tray, when sheet processing is carried out on the one or more sheets on the processing tray.

10. The sheet processing apparatus according to claim 1, further comprising:

a standby tray disposed above the processing tray and movable such that a sheet thereon falls onto the processing tray, wherein the movable guide moves from a standby position above the standby tray to a dropping position above the sheet pressing position to direct the sheet toward the processing tray when the sheet on the standby tray falls onto the processing tray.

11. The sheet processing apparatus according to claim 1, further comprising:

a controller configured to cause the movable guide to move upward from the sheet pressing position after the pushing member passes an end portion of the movable guide pressing the one or more sheet.

12. The sheet processing apparatus according to claim 1, further comprising:

a controller configured to cause the movable guide to move upward from the sheet pressing position before the pushing member passes an end portion of the movable guide pressing the one or more sheet.

13. A sheet processing method comprising:

processing one or more sheets placed on a sheet processing tray;

placing a pushing member to contact an edge of the one or more sheets on the processing tray on an upstream side in a sheet conveying direction;

moving the pushing member along a surface of the processing tray in the sheet conveying direction, while pressing an upstream end region of an upper surface of a top sheet of the one or more sheets in the sheet conveying direction towards the sheet processing tray; and determining the number of the one or more sheets, wherein when the number of the one or more sheets are determined to be above a predetermined number, the pushing member is moved while the upstream end region of the upper surface of the top sheet is pressed.

14. The sheet processing method according to claim 13, further comprising:

determining the size of the one or more sheets, wherein when the size of the one or more sheets are determined to satisfy a predetermined condition, the pushing member is moved while the upstream end region of the upper surface of the top sheet is pressed.

15. The sheet processing method according to claim 13, wherein the upstream end region of the upper surface of the top sheet is not pressed while the one or more sheets on the sheet processing tray are processed.

16. The sheet processing method according to claim 13, further comprising:

terminating the pressing after the pushing member passes the upstream end region of the upper surface of the top sheet.

17. The sheet processing method according to claim 13, further comprising:

terminating the pressing before the pushing member passes the upstream end region of the upper surface of the top sheet.

18. A sheet processing apparatus comprising:

a processing tray on which one or more sheets to be processed are placeable for sheet processing;

a pushing member configured to push an edge of the one or more sheets on the processing tray on an upstream side in a sheet conveying direction, by moving along a surface of the processing tray in the sheet conveying direction;

a movable guide movable to a sheet pressing position at which a distance between the surface of the processing tray and the movable guide is equal to or less than a height of the pushing member above the surface of the processing tray, wherein the movable guide is at the sheet processing position when the pushing member moves along the surface of the processing tray in the sheet conveying direction; and a controller configured to change the sheet pressing position of the movable guide based on the number of the one or more sheets.

19. A sheet processing apparatus comprising:

a processing tray on which one or more sheets to be processed are placeable for sheet processing;

a pushing member configured to push an edge of the one or more sheets on the processing tray on an upstream side in a sheet conveying direction, by moving along a surface of the processing tray in the sheet conveying direction;

a movable guide movable to a sheet pressing position at which a distance between the surface of the processing tray and the movable guide is equal to or less than a height of the pushing member above the surface of the processing tray, wherein the movable guide is at the sheet processing position when the pushing member moves along the surface of the processing tray in the sheet conveying direction; and a controller configured to cause the movable guide to move to the sheet pressing position when the number of the one or more sheets is less than a predetermined number.

20. A sheet processing apparatus comprising:

a processing tray on which one or more sheets to be processed are placeable for sheet processing;

a pushing member configured to push an edge of the one or more sheets on the processing tray on an upstream side in a sheet conveying direction, by moving along a surface of the processing tray in the sheet conveying direction;

a movable guide movable to a sheet pressing position at which a distance between the surface of the processing tray and the movable guide is equal to or less than a height of the pushing member above the surface of the processing tray, wherein the movable guide is at the sheet processing position when the pushing member moves along the surface of the processing tray in the sheet conveying direction; and a controller configured to cause the movable guide to move to the sheet pressing position when a size of the one or more sheets satisfies a predetermined condition.

21. A sheet processing apparatus comprising:

a processing tray on which one or more sheets to be processed are placeable for sheet processing;

a standby tray disposed above the processing tray and movable such that a sheet thereon falls onto the processing tray;

a pushing member configured to push an edge of the one or more sheets on the processing tray on an upstream side in a sheet conveying direction, by moving along a surface of the processing tray in the sheet conveying direction;

a movable guide movable to a sheet pressing position at which a distance between the surface of the processing tray and the movable guide is equal to or less than a height of the pushing member above the surface of the processing tray, wherein the movable guide is at the sheet processing position when the pushing member moves along the surface of the processing tray in the sheet conveying direction, and the movable guide moves from a standby position above the standby tray to a dropping position above the sheet pressing position to direct the sheet toward the processing tray when the sheet on the standby tray falls onto the processing tray.

22. A sheet processing apparatus comprising:

a processing tray on which one or more sheets to be processed are placeable for sheet processing;

a pushing member configured to push an edge of the one or more sheets on the processing tray on an upstream side in a sheet conveying direction, by moving along a surface of the processing tray in the sheet conveying direction; and a movable guide movable to a sheet pressing position at which a distance between the surface of the processing tray and the movable guide is equal to or less than a height of the pushing member above the surface of the processing tray, wherein the movable guide is at the sheet processing position when the pushing member moves along the surface of the processing tray in the sheet conveying direction; and a controller configured to cause the movable guide to move upward from the sheet pressing position after the pushing member passes an end portion of the movable guide pressing the one or more sheet.

23. A sheet processing apparatus comprising:

a processing tray on which one or more sheets to be processed are placeable for sheet processing;

a pushing member configured to push an edge of the one or more sheets on the processing tray on an upstream side in a sheet conveying direction, by moving along a surface of the processing tray in the sheet conveying direction; and a movable guide movable to a sheet pressing position at which a distance between the surface of the processing tray and the movable guide is equal to or less than a height of the pushing member above the surface of the processing tray, wherein the movable guide is at the sheet processing position when the pushing member moves along the surface of the processing tray in the sheet conveying direction; and a controller configured to cause the movable guide to move upward from the sheet pressing position before the pushing member passes an end portion of the movable guide pressing the one or more sheet.

24. A sheet processing method comprising:

processing one or more sheets placed on a sheet processing tray;

placing a pushing member to contact an edge of the one or more sheets on the processing tray on an upstream side in a sheet conveying direction;

moving the pushing member along a surface of the processing tray in the sheet conveying direction, while pressing an upstream end region of an upper surface of a top sheet of the one or more sheets in the sheet conveying direction towards the sheet processing tray; and determining the size of the one or more sheets, wherein when the size of the one or more sheets are determined to satisfy a predetermined condition, the pushing member is moved while the upstream end region of the upper surface of the top sheet is pressed.

25. A sheet processing method comprising:

processing one or more sheets placed on a sheet processing tray;

placing a pushing member to contact an edge of the one or more sheets on the processing tray on an upstream side in a sheet conveying direction;

moving the pushing member along a surface of the processing tray in the sheet conveying direction, while pressing an upstream end region of an upper surface of a top sheet of the one or more sheets in the sheet conveying direction towards the sheet processing tray; and terminating the pressing after the pushing member passes the upstream end region of the upper surface of the top sheet.

26. A sheet processing method comprising:

processing one or more sheets placed on a sheet processing tray;

placing a pushing member to contact an edge of the one or more sheets on the processing tray on an upstream side in a sheet conveying direction;

moving the pushing member along a surface of the processing tray in the sheet conveying direction, while pressing an upstream end region of an upper surface of a top sheet of the one or more sheets in the sheet conveying direction towards the sheet processing tray; and terminating the pressing before the pushing member passes the upstream end region of the upper surface of the top sheet.

* * * * *